US009693125B2

(12) United States Patent
MacDonald et al.

(10) Patent No.: US 9,693,125 B2
(45) Date of Patent: Jun. 27, 2017

(54) LOUDSPEAKER CABINET STAND

(71) Applicant: Bose Corporation, Framingham, MA (US)

(72) Inventors: Thomas E. MacDonald, Boston, MA (US); Peter C. Santoro, Groton, MA (US); Robert A. Warden, Southborough, MA (US)

(73) Assignee: Bose Corporation, Framingham, MA (US)

( * ) Notice: Subject to any disclaimer, the term of this patent is extended or adjusted under 35 U.S.C. 154(b) by 279 days.

(21) Appl. No.: 14/526,599

(22) Filed: Oct. 29, 2014

(65) Prior Publication Data

US 2016/0127813 A1 May 5, 2016

(51) Int. Cl.
*H04R 1/02* (2006.01)

(52) U.S. Cl.
CPC ..... *H04R 1/02* (2013.01); *H04R 1/026* (2013.01); *H04R 2201/025* (2013.01)

(58) Field of Classification Search
CPC ..... H04R 1/02
USPC ..... 381/304, 332, 182
See application file for complete search history.

(56) References Cited

U.S. PATENT DOCUMENTS 4,757,544 A * 7/1988 Guy ..... H04R 1/323 381/304
4,953,223 A * 8/1990 Householder ..... F16M 11/24 381/182
7,319,767 B2 1/2008 Fidlin et al.
2006/0222190 A1 10/2006 Jacobs et al.
2010/0111342 A1* 5/2010 Jacob ..... H04R 1/26 381/332

FOREIGN PATENT DOCUMENTS

DE 29708603 U1 9/1997
DE 19831221 A1 12/1998
DE 202009011146 U1 12/2009
EP 1494502 A2 1/2005

OTHER PUBLICATIONS

The International Search Report and the Written Opinion of the International Searching Authority mailed on Feb. 3, 2016 for corresponding PCT Application No. PCT/US2015/057561.

* cited by examiner

*Primary Examiner* — Duc Nguyen
*Assistant Examiner* — Phan Le
(74) *Attorney, Agent, or Firm* — Brian M. Dingman; Dingman IP Law, PC

(57) ABSTRACT

A stand that is adapted to support an upper loudspeaker cabinet relative to a lower loudspeaker cabinet. The stand has a first structure that is constructed and arranged to be directly coupled to a first portion of the lower loudspeaker cabinet in a stand stowed position wherein the stand is stowed on or in the lower loudspeaker cabinet, and a second structure that is constructed and arranged to be directly coupled to a second portion of the lower loudspeaker cabinet in a stand deployed position wherein the stand is supported by and extends above the lower loudspeaker cabinet. The stand is further constructed and arranged to support the upper loudspeaker cabinet when the stand is in the deployed position.

23 Claims, 20 Drawing Sheets

LOUDSPEAKER CABINET STAND

BACKGROUND

This disclosure relates to a stand that supports a loudspeaker cabinet.

Stage performers sometimes mount one loudspeaker cabinet above another loudspeaker cabinet. The lower loudspeaker cabinet may be a subwoofer, and the upper may be a mid-high range loudspeaker. Usually the upper loudspeaker cabinet needs to be mounted several feet above the lower loudspeaker cabinet. In some approaches, a mounting pole is held upright by the lower loudspeaker cabinet, and the upper loudspeaker cabinet is lifted up and placed on the pole. This action requires the user to hold a heavy loudspeaker cabinet (weighing perhaps 45-50 pounds) up at about eye level while aligning a small opening in the bottom of the cabinet with the top of the pole. This exercise is physically demanding, and may be dangerous.

SUMMARY

The subject loudspeaker cabinet stand is adapted to support an upper loudspeaker cabinet above a lower loudspeaker cabinet. The stand is constructed such that it can be stowed on or in the lower loudspeaker cabinet. The stand is also constructed such that when it is deployed it engages with the lower loudspeaker cabinet. The stand includes a structure that is able to support the upper loudspeaker cabinet above the lower loudspeaker cabinet when the stand is deployed.

All examples and features mentioned below can be combined in any technically possible way.

In one aspect, a stand that is adapted to support an upper loudspeaker cabinet relative to a lower loudspeaker cabinet includes a first structure that is constructed and arranged to be directly coupled to a first portion of the lower loudspeaker cabinet in a stand stowed position wherein the stand is stowed on or in the lower loudspeaker cabinet, and a second structure that is constructed and arranged to be directly coupled to a second portion of the lower loudspeaker cabinet in a stand deployed position. The stand is supported by and extends above the lower loudspeaker cabinet. The stand is further constructed and arranged to support the upper loudspeaker cabinet when the stand is in the deployed position.

Examples may include one of the following features, or any combination thereof. The first structure may include a recess that is constructed and arranged to receive a movable latch of the lower loudspeaker cabinet. The second structure may include a wedge that is constructed and arranged to be received in a receiving pocket of the lower loudspeaker cabinet.

Examples may include one of the above and/or below features, or any combination thereof. The stand may support the upper loudspeaker cabinet with an interface structure. The interface structure may be part of a platform. The stand may have multiple legs that support the platform. The interface structure may comprise a tapered recess in the top of the platform. The tapered recess may comprise an annular recess bounded by inwardly-tapered outer walls and outwardly-tapered inner walls. The inward taper of the outer recess walls may be greater than the outward taper of the inner recess walls. Each leg may include a wedge at one end thereof. The stand may further include a channel along a length of at least one leg and that is constructed and arranged to receive an electrical cord therein.

In another aspect, an assembly that is adapted to support an upper loudspeaker cabinet includes a bass loudspeaker cabinet and a stand. The stand includes a first structure that is constructed and arranged to be directly coupled to a first portion of the bass loudspeaker cabinet in a stand stowed position wherein the stand is stowed on or in the bass loudspeaker cabinet, a second structure that is constructed and arranged to be directly coupled to a second portion of the bass loudspeaker cabinet in a stand deployed position wherein the stand is supported by and extends above the bass loudspeaker cabinet, and a third structure that is constructed and arranged to be coupled to the upper loudspeaker cabinet when the stand is in the deployed position.

Examples may include one of the following features, or any combination thereof. The bass loudspeaker cabinet may include a movable latch, and the first structure of the stand may comprise a recess that is constructed and arranged to receive and engage the latch. The second portion of the bass loudspeaker cabinet may include one or more receiving pockets and the second structure of the stand may include one or more wedges, each of which is constructed and arranged to be received in a receiving pocket of the bass loudspeaker cabinet. The assembly may further include one or more elastomeric bumpers in the first portion of the bass loudspeaker cabinet.

Examples may include one of the above and/or below features, or any combination thereof. The third structure of the stand may include an interface structure that supports the upper loudspeaker cabinet. The stand may include a platform that includes the interface structure. The stand may have multiple legs that support the platform. The interface structure may include a tapered recess in the top of the platform. The tapered recess may include an annular recess bounded by inwardly-tapered outer walls and outwardly-tapered inner walls. The inward taper of the outer recess walls may be greater than the outward taper of the inner recess walls. The assembly may further include an interface coupling member that is adapted to be coupled to the upper loudspeaker cabinet and comprises an annular wedge-shaped projection that is shaped to fit into the tapered recess. Each leg may comprise a wedge at one end thereof. At least one leg may comprise a channel along a length of such leg and that is constructed and arranged to receive an electrical cord therein. The stand may have two legs that depend from opposite ends of the platform, and the bass loudspeaker cabinet may have a shelf that is constructed and arranged to support the platform in the stand stowed position, and two recesses, the recesses located below and adjacent to each end of the shelf, wherein in the stand stowed position one leg of the stand is received in each recess.

In another aspect, an assembly that is adapted to support an upper loudspeaker cabinet includes a bass loudspeaker cabinet and a stand comprising two legs that depend from opposite ends of a platform. The stand includes a first structure that is constructed and arranged to be directly coupled to a first portion of the bass loudspeaker cabinet in a stand stowed position wherein the stand is stowed on or in the bass loudspeaker cabinet, and a second structure that is constructed and arranged to be directly coupled to a second portion of the bass loudspeaker cabinet in a stand deployed position wherein the stand is supported by and extends above the bass loudspeaker cabinet. The second portion of the bass loudspeaker cabinet comprises receiving pockets, and the second structure of the stand comprises a wedge at an end of each leg opposite the platform. Each of the wedges is constructed and arranged to be received in a receiving pocket of the bass loudspeaker cabinet. The stand has a tapered recess interface structure on the top of the platform. The interface structure is constructed and arranged to be coupled to and support the upper loudspeaker cabinet when the stand is in the deployed position. The bass loudspeaker cabinet comprises a shelf that is constructed and arranged to support the platform in the stand stowed position, and two recesses, the recesses located below and adjacent to each end of the shelf, wherein in the stand stowed position one leg of the stand is received in each recess. The tapered recess of the stand's platform may comprise an annular recess bounded by inwardly-tapered outer walls and outwardly-tapered inner walls, wherein the inward taper of the outer recess walls is greater than the outward taper of the inner recess walls, the assembly further comprising an interface coupling member that is adapted to be coupled to the upper loudspeaker cabinet and comprises an annular wedge-shaped projection that is shaped to fit into the tapered recess of the platform.

BRIEF DESCRIPTION OF THE DRAWINGS

FIG. 1 includes several views of a loudspeaker cabinet stand, in which

DETAILED DESCRIPTION

Figure 1A:
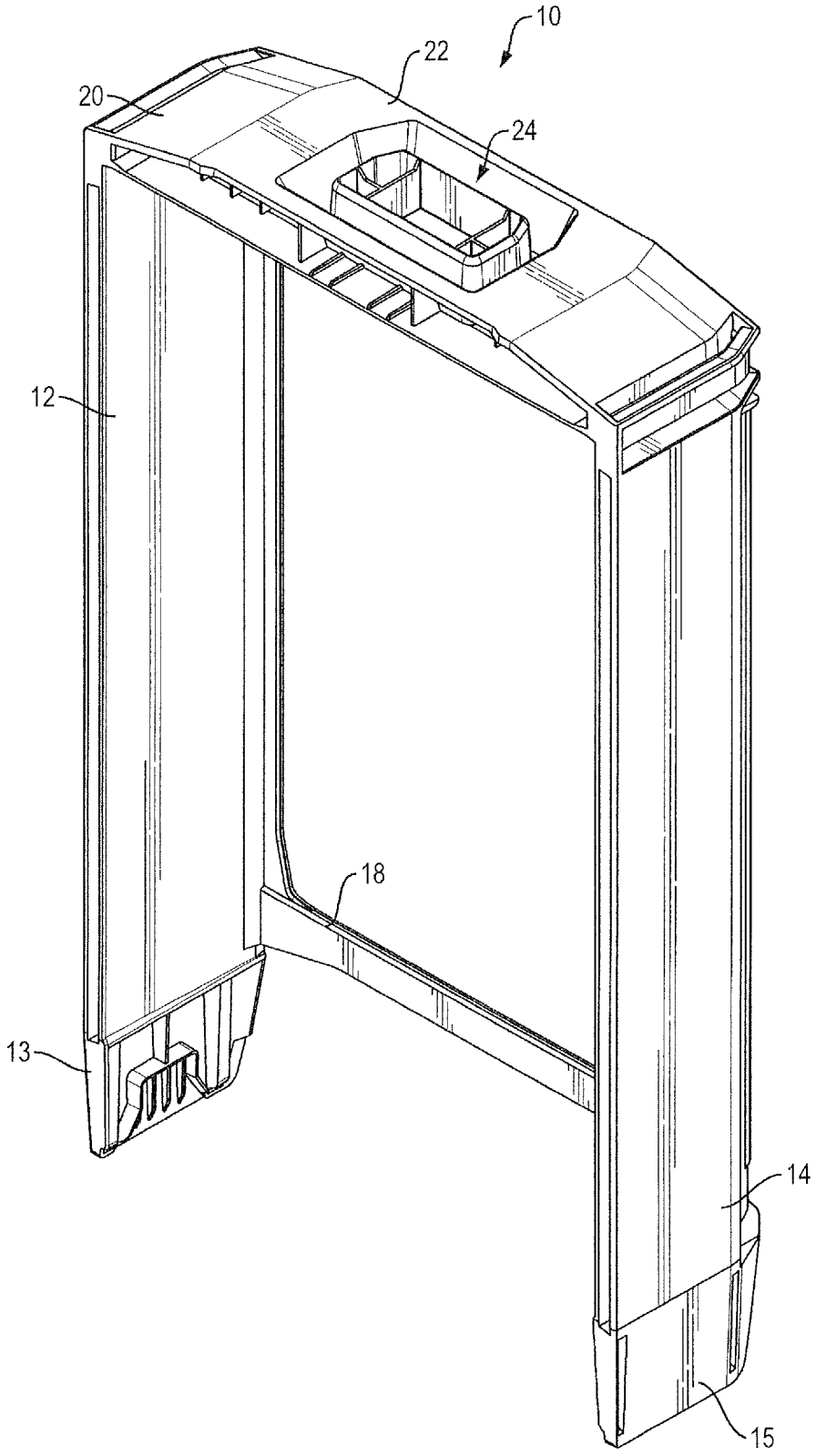
FIG. 1A is a front perspective view.
Figure 1B:
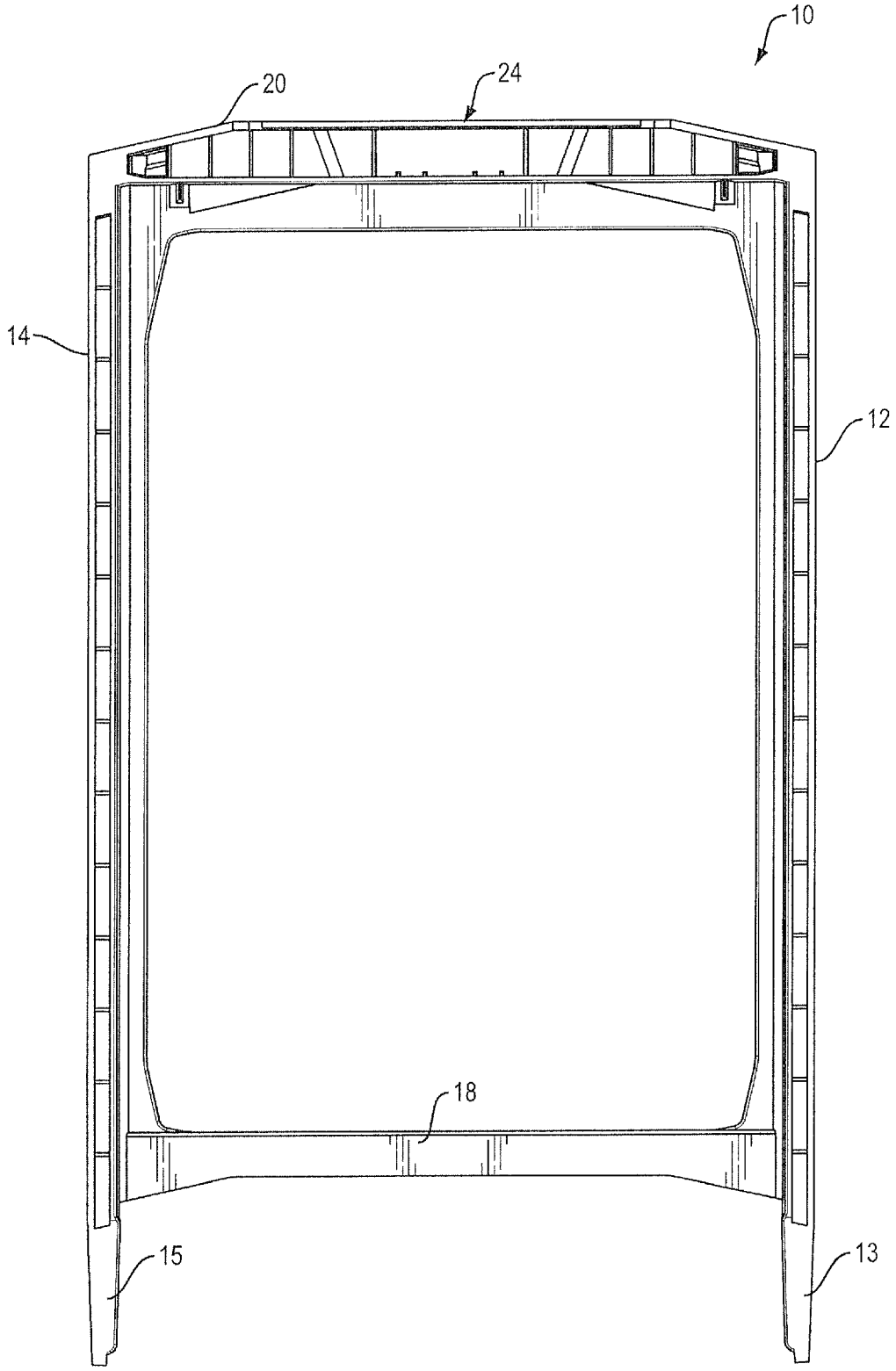
FIG. 1B is a rear view.
Figure 1C:
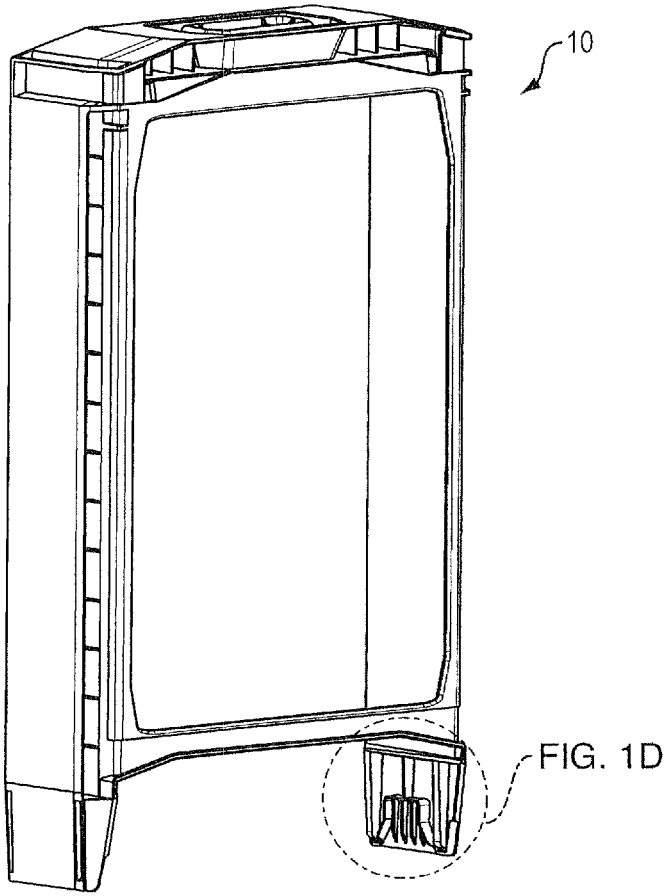
FIG. 1C is a rear perspective view with FIG. 1D being an enlarged partial view thereof.
Figure 1D:
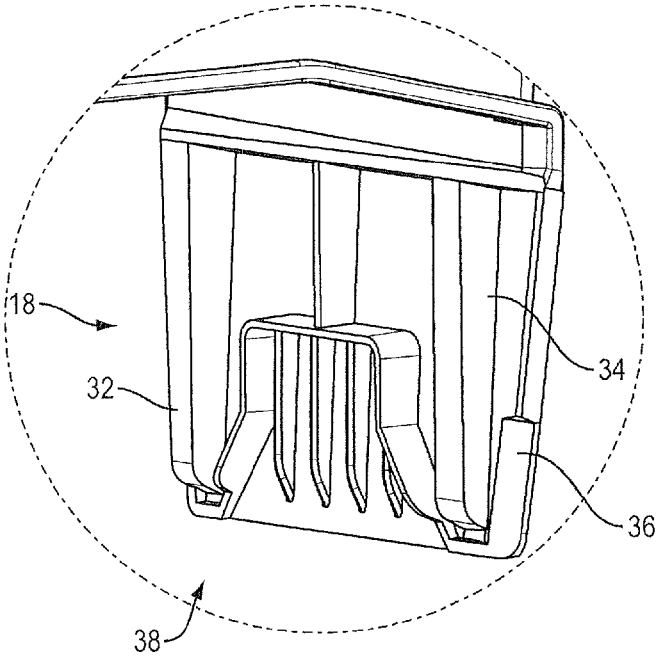

The subject stand is adapted to support an upper loudspeaker cabinet above a lower loudspeaker cabinet. The stand is constructed such that it can be stowed on or in the lower loudspeaker cabinet when the stand is not in use. The stand is also constructed such that when it is deployed it engages with and extends above the lower loudspeaker cabinet. The stand includes additional structure that supports the upper loudspeaker cabinet above the lower loudspeaker cabinet. This additional structure can be part of a platform that is supported above the lower loudspeaker cabinet. The platform allows the user to place the upper loudspeaker on the stand without precisely aligning the upper loudspeaker with a corresponding mating mechanism on the stand, such that the weight is supported by the stand until the loudspeaker mates with the stand. For example, the stand and upper cabinet can include mating interface structures. The upper cabinet can be slid onto the platform of the stand until these structures engage. The act of engaging the upper loudspeaker on the stand is thus decoupled from that act of having to hold up the substantial weight of the upper loudspeaker.

An example of a loudspeaker cabinet stand 10 is shown in FIG. 1. Stand 10 includes legs 12 and 14 which depend from opposite ends of upper platform 20. Lower cross member 18 helps to strengthen the stand and maintain the legs in the depending vertical position shown. The lower or distal end of each leg comprises a wedge 13 and 15. These wedges are constructed and arranged to be directly coupled to portions of a lower loudspeaker cabinet in a stand deployed position, which is further described below. Stand 10 is constructed and arranged to support an upper loudspeaker cabinet when the stand is in the deployed position. In this non-limiting example, and as further described below, the upper loudspeaker cabinet sits on and is coupled to platform 20. Specifically, platform 20 includes central area 22 which has an interface structure 24 which is a mounting location for a complementary feature on the lower side of the upper loudspeaker cabinet, as described in detail below.

Wedges 13 and 15 may be mirror images of one another. Wedge 13 is shown in detail in FIG. 1D. Wedge 13 comprises front side ridge 32 and back side ridge 34. Adjacent seating structure 36 fits into a complementary shaped receptacle in the lower loudspeaker cabinet, described below. These complementary structures ensure the proper front-to-front alignment of the stand and the lower loudspeaker cabinet, also as further described below. Wedge 13 may also include strengthening structure 38 which comprises a number of ribs that help to strengthen the wedge such that the tapered wedge structure is able to support the weight of the stand and the upper loudspeaker.

Figure 1E:
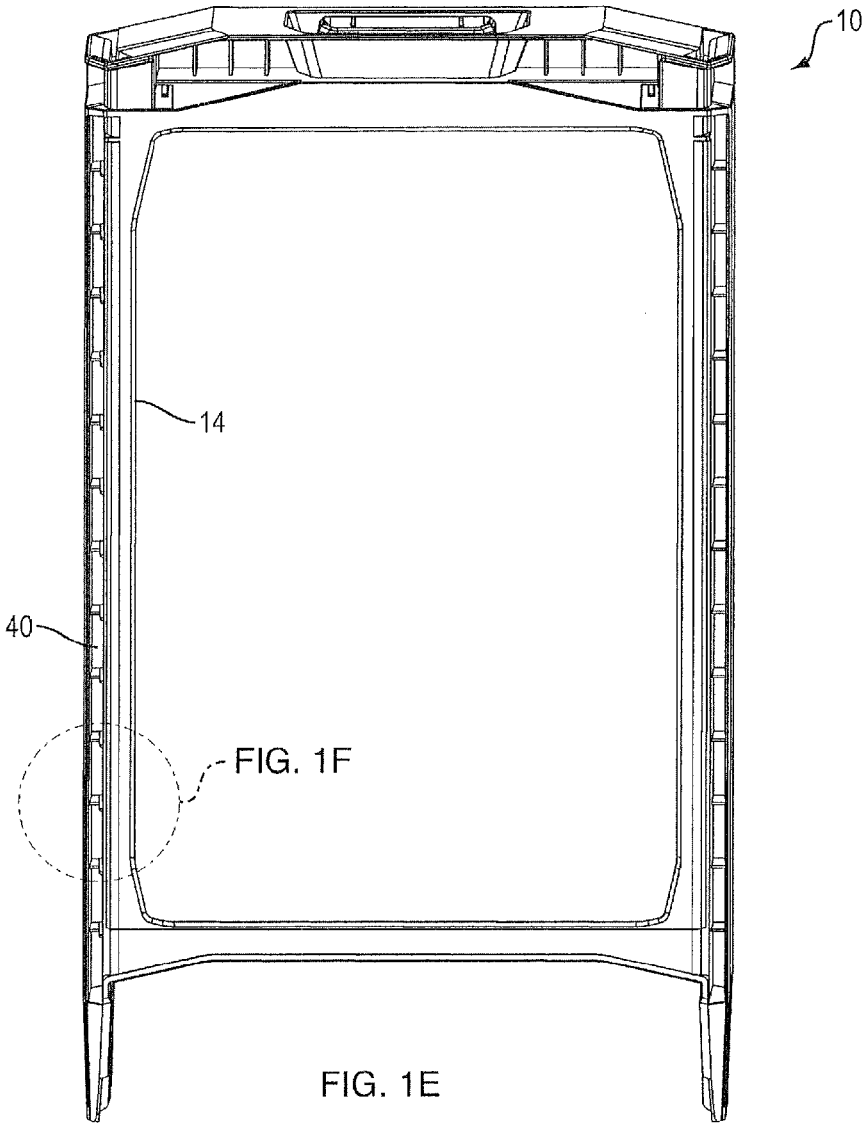
FIG. 1E is a rear view with FIG. 1F being an enlarged partial view thereof.
Figure 1F:
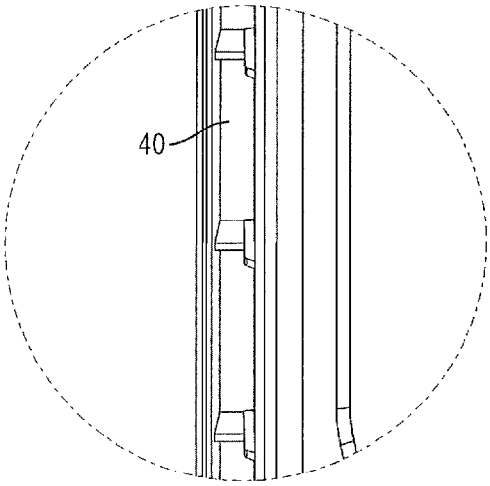

As shown in FIGS. 1E and 1F, stand 10 also may include along the length of each leg a channel 40 which defines longitudinal recess that can receive an electrical cord. This feature allows one or more cords that run between the upper and lower loudspeaker cabinets to be stowed in the stand to present a neater appearance. This feature also discourages dangling cords, which can be a safety concern.

In one non-limiting example, power and/or information signals (e.g., an audio signal) may be-provided to the upper loudspeaker via a mating mechanism in the stand. This can be useful if the upper loudspeaker includes an integral amplifier, which requires electrical power in order to operate. Power and/or information signals can be provided over a cord that can be but need not be located in channel 40. The provision of power and/or information signals to an upper loudspeaker that is stacked over a loudspeaker base is further disclosed in U.S. Pat. No. 7,319,767, the disclosure of which is incorporated herein by reference in its entirety.

Figure 1G:
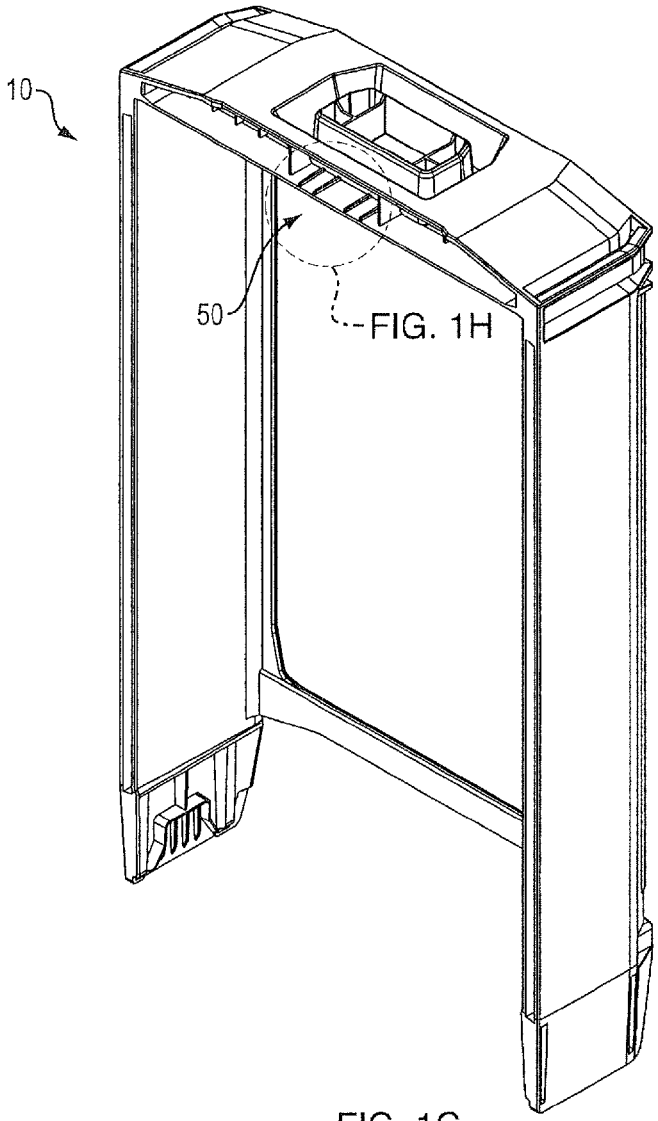
FIG. 1G is a front perspective view with FIG. 1H being an enlarged partial view thereof.
Figure 1H:
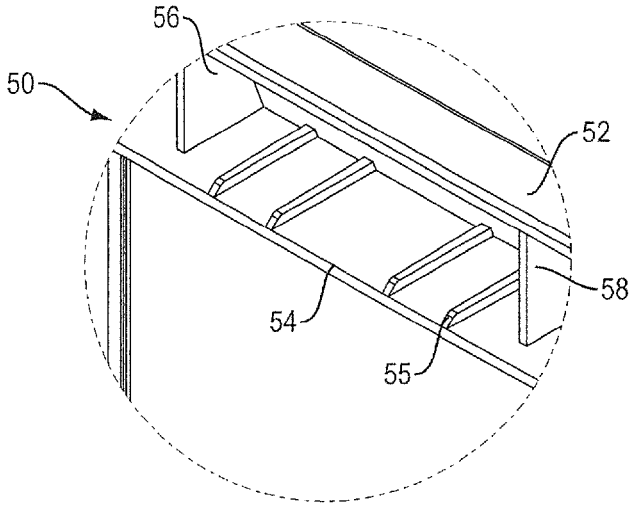

Stand 10 further includes recess 50, as shown in FIGS. 1G and 1H, which is constructed and arranged to be directly coupled to a portion of the lower loudspeaker cabinet when the stand is stowed on or in the lower loudspeaker cabinet, as further described below. Recess or first structure 50 is defined by sidewalls 56 and 58, top wall 52, and lower wall 54 which may be strengthened with ribs 55.

Figure 2A:
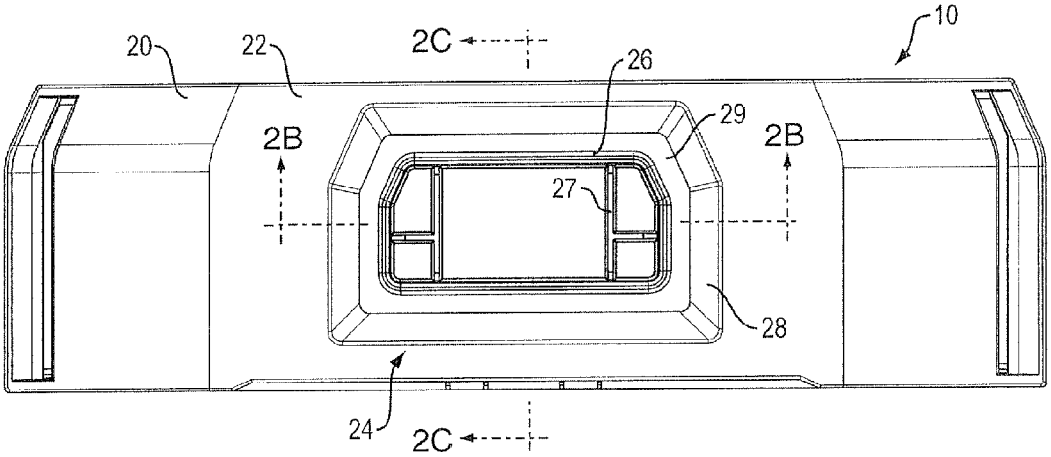
FIG. 2A is a top view of the loudspeaker cabinet stand of FIG. 1.
Figure 2B:
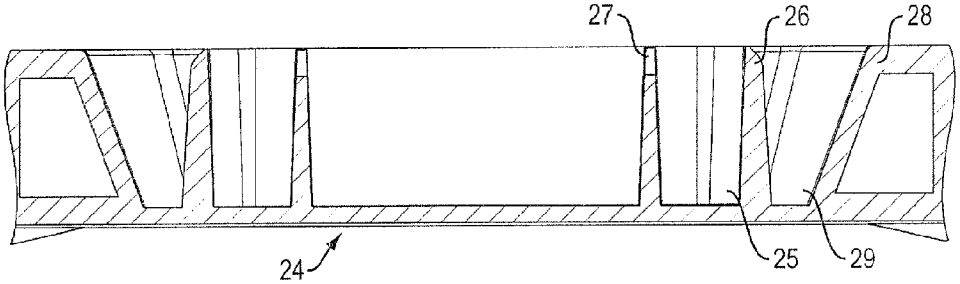
FIG. 2B is a cross sectional view taken along line J-J of FIG. 2A.
Figure 2C:
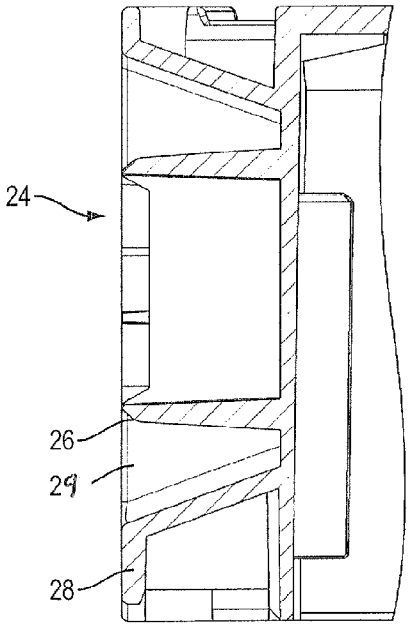
FIG. 2C is a cross-sectional view taken along line H-H of FIG. 2A.
Figure 3A:
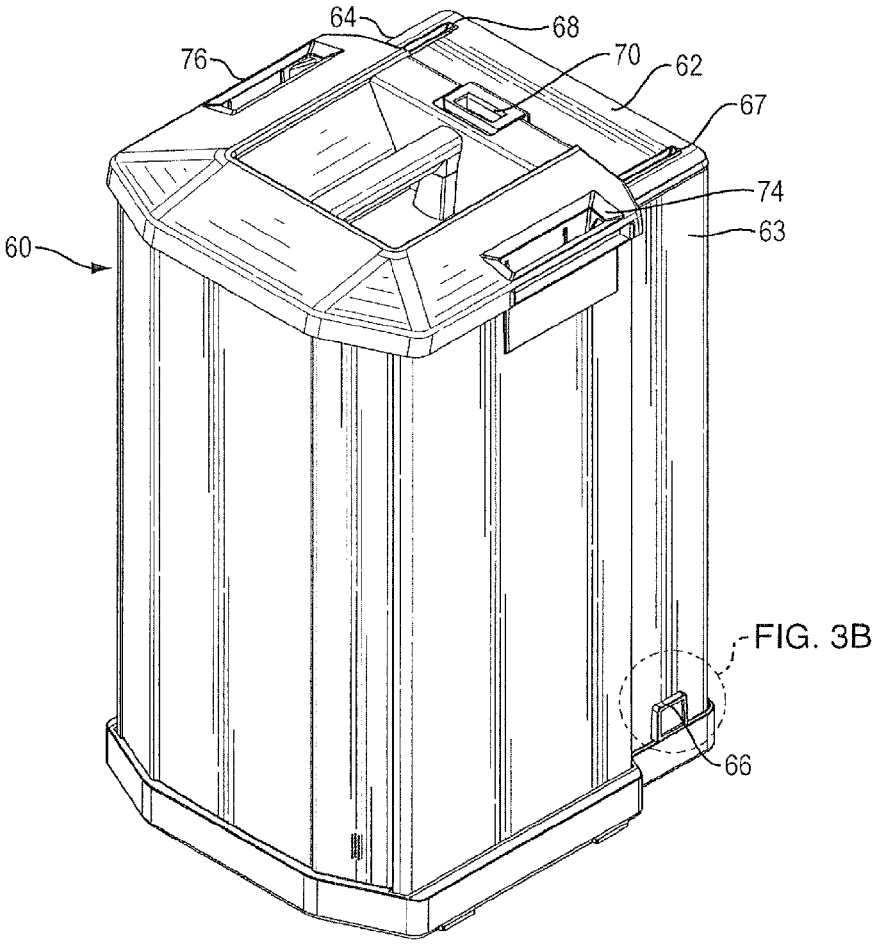
FIG. 3A is a front perspective view of a lower loudspeaker cabinet.
Figure 3B:
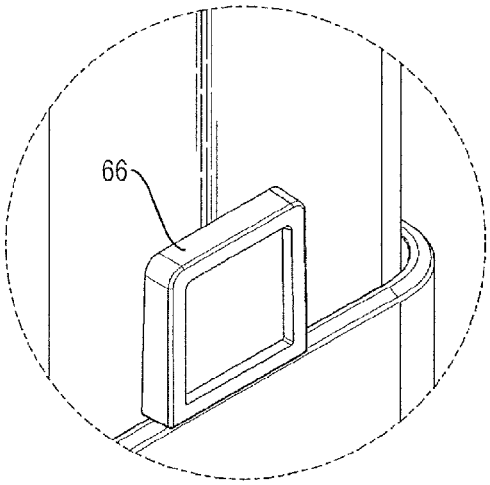
FIG. 3B is an enlarged partial view of a portion of the lower loudspeaker cabinet of FIG. 3A.
Figure 3C:
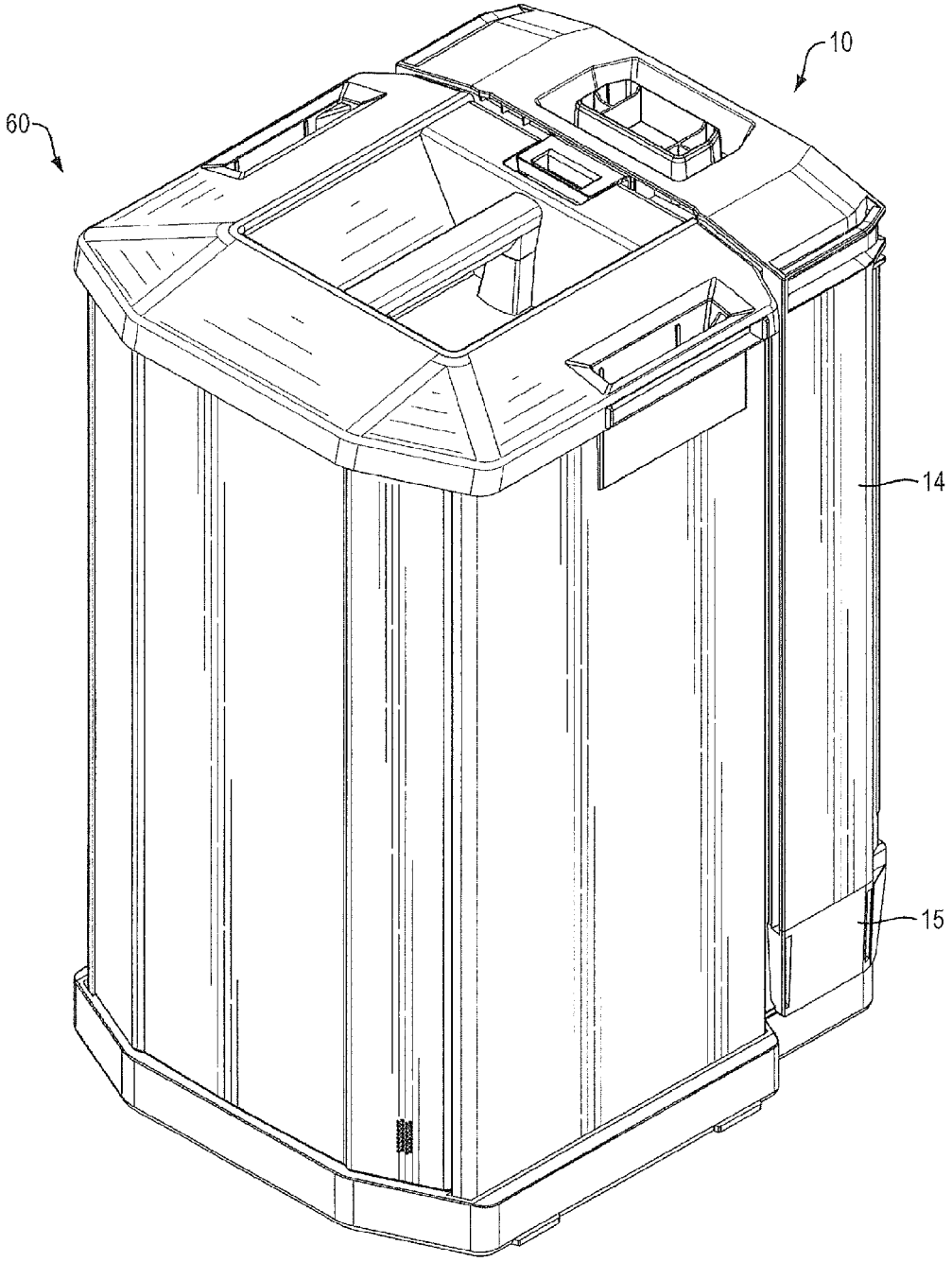
FIG. 3C is a view similar to that of FIG. 3A but with the stand of FIG. 1 stowed on the lower loudspeaker cabinet.
Figure 3D:
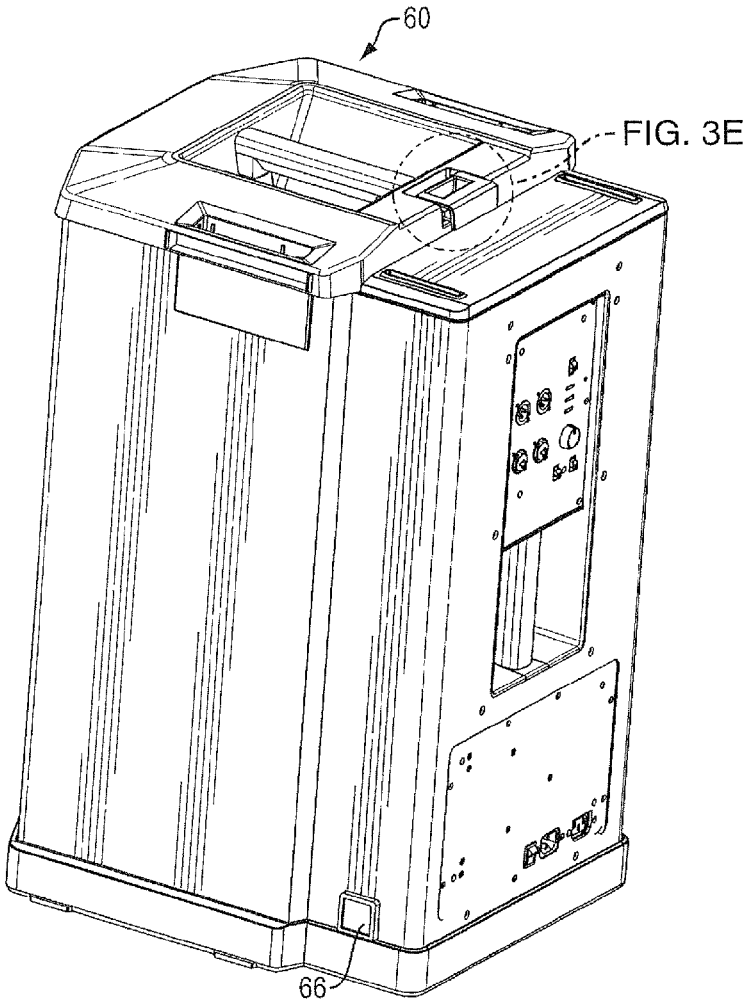
FIG. 3D is a rear perspective view of the lower loudspeaker cabinet, with FIG. 3E being an enlarged partial view thereof.
Figure 3E:
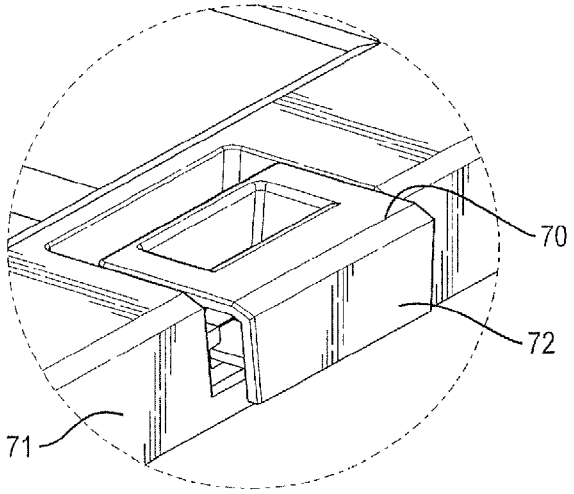

Interface structure 24 is shown in detail in FIGS. 2A, 2B and 2C. Interface structure 24 comprises a tapered recess 29 in central area 22 of platform 20. Recess 29 is defined between inwardly tapered outer wall 28 and outwardly tapered inner wall 26. Ribs 27 (spaced by space 25 from wall 26) provide strengthening to wall 26. In this non-limiting example the taper of wall 28 is greater than the taper of wall 26 so that wall 28 provides a ramp feature that eases the fitting of a wedge into recess 29, as further explained below. In other examples, the taper of the outer wall 28 and inner wall 26 may be the reverse of those shown, or the two tapers may be the same. Recess 29 is generally annular but is shaped differently in the front and rear portions, and may be other shapes. As explained below, the interface coupling member of the upper loudspeaker cabinet that mates with interface structure 24 has a complementary shape. This aspect ensures that the upper loudspeaker cabinet is properly seated in the stand and is facing forward when it is properly mounted on the stand.

Figure 6B:
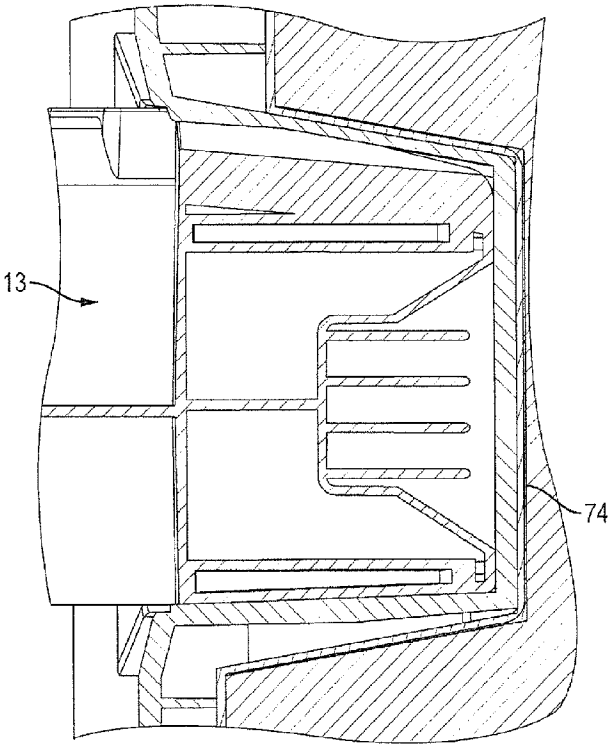
FIG. 6B is a partial cross-sectional view taken along line E-E of FIG. 6A.
Figure 6A:
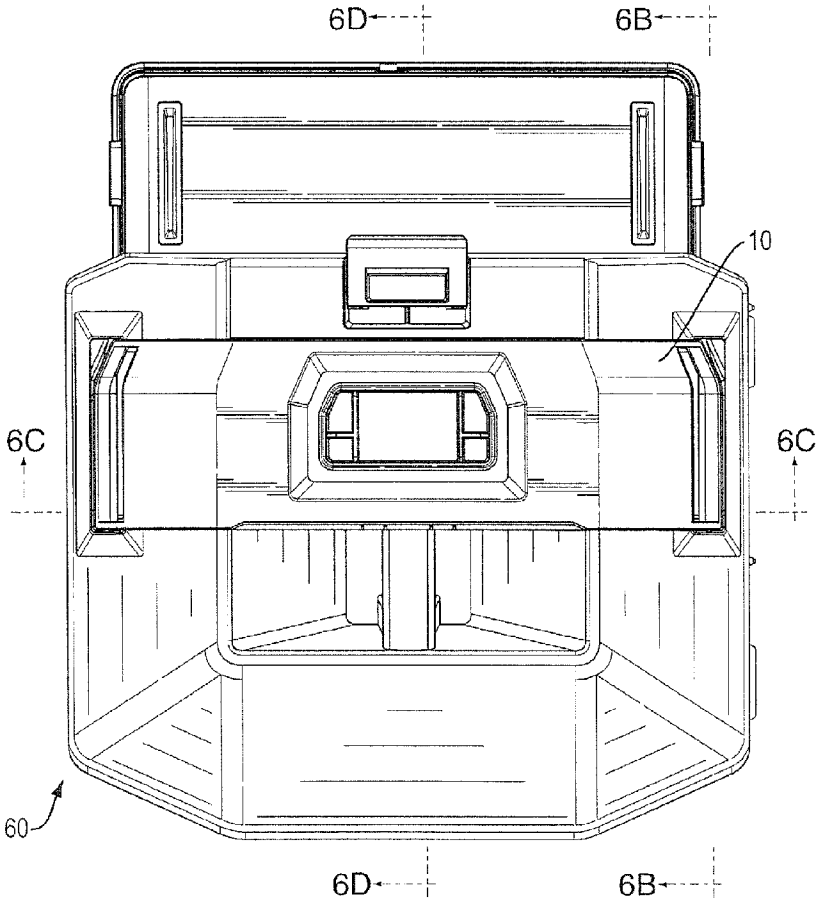
FIG. 6A is a top view of the partial assembly shown in FIG. 4.
Figure 6D:
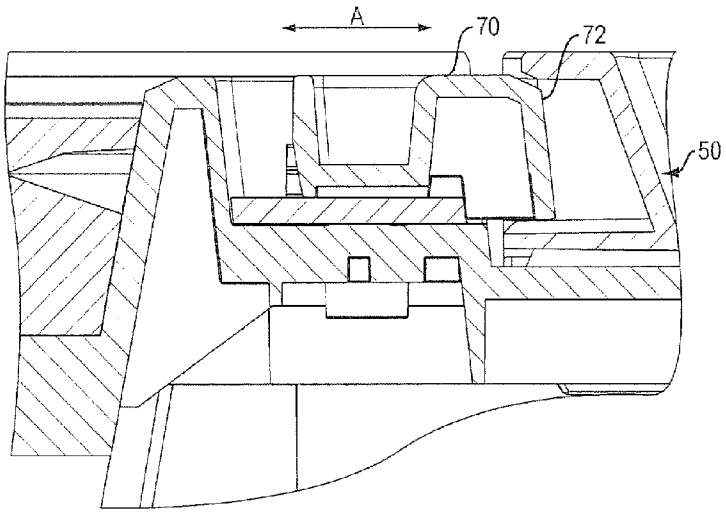
FIG. 6D is a partial cross-sectional view taken along line G-G of FIG. 6A.

A non-limiting example of a lower loudspeaker cabinet 60 is shown in FIG. 3. Cabinet 60 has a rear portion that is constructed and arranged to receive stand 10 in a stand stowed position. The rear portion comprises horizontal shelf 62 and adjacent vertical recesses 63 and 64. The shelf and recesses are sized and shaped to fit platform 20 and legs 12 and 14 of the stand 10 therein. One or more elastomeric bumpers 67, 68 and 66 may be disposed on the stand 10 to provide resting points of stand 10 so that the material of stand 10 does not sit directly against the material of loudspeaker cabinet 60. This can help prevent unwanted vibration of stand 10. FIG. 3C shows the stand in the stowed position, with platform 20 sitting on shelf 62, and legs 12 and 14 located in recesses 63 and 64. Loudspeaker cabinet 60 may also have latch 70 with engaging portion 72 (as shown in FIG. 3E). Latch 70 is constructed and arranged to be slid in and out with respect to cabinet wall 71. Portion 72 is sized and shaped to fit into recess 50 of stand 10. The latch 70 thus is directly coupled to stand 10 when the stand is in the stowed position to help maintain the stand in this stowed position. To release the stand from loudspeaker cabinet 60, latch 70 is slid back into the stand (to the left in FIG. 3E) to release the stand and allow it to be lifted off of loudspeaker cabinet 60. This feature is further shown in FIG. 6D, wherein arrow "A" illustrates the direction of motion of latch 70.

Figure 4:
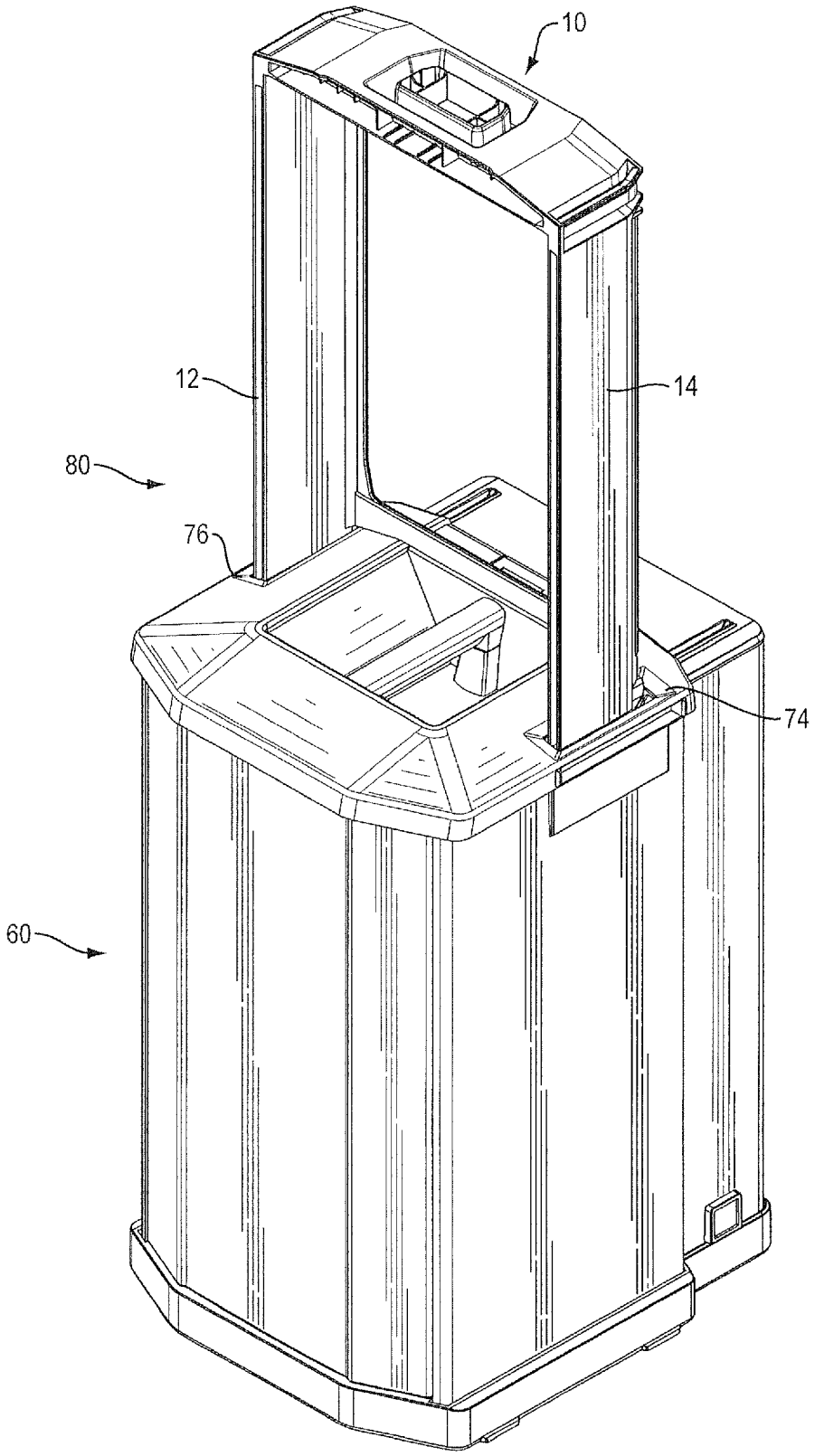
FIG. 4 is a front perspective view of a partial assembly comprising the stand and lower loudspeaker cabinet shown in FIGS. 1 through 3.
Figure 5B:
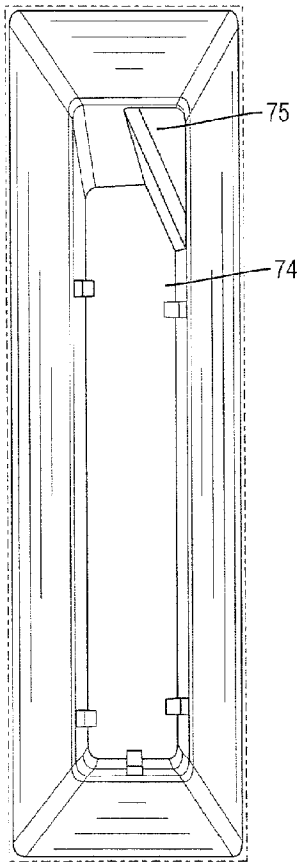
FIG. 5A is a top view of the stand mounted on the lower loudspeaker cabinet, with FIG. 5B being an enlarged partial view thereof.
Figure 5A:
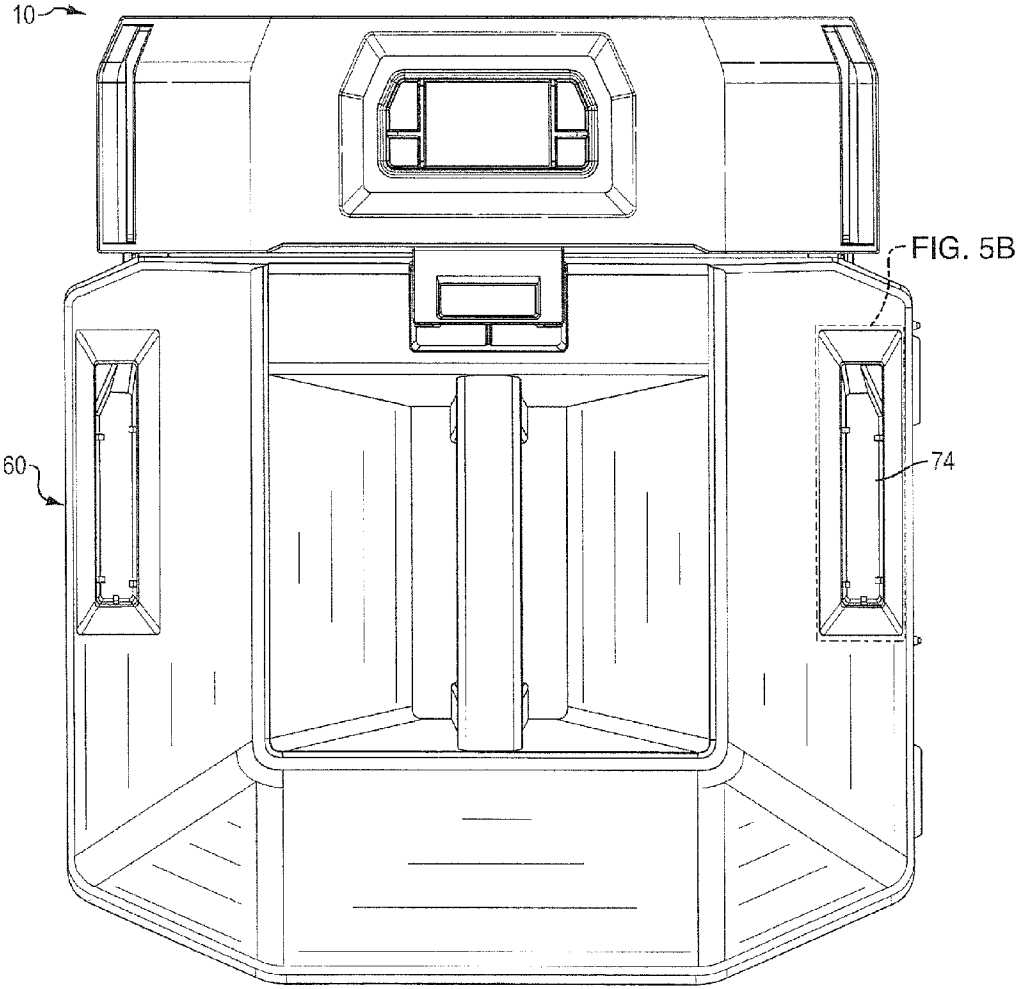
Figure 6C:
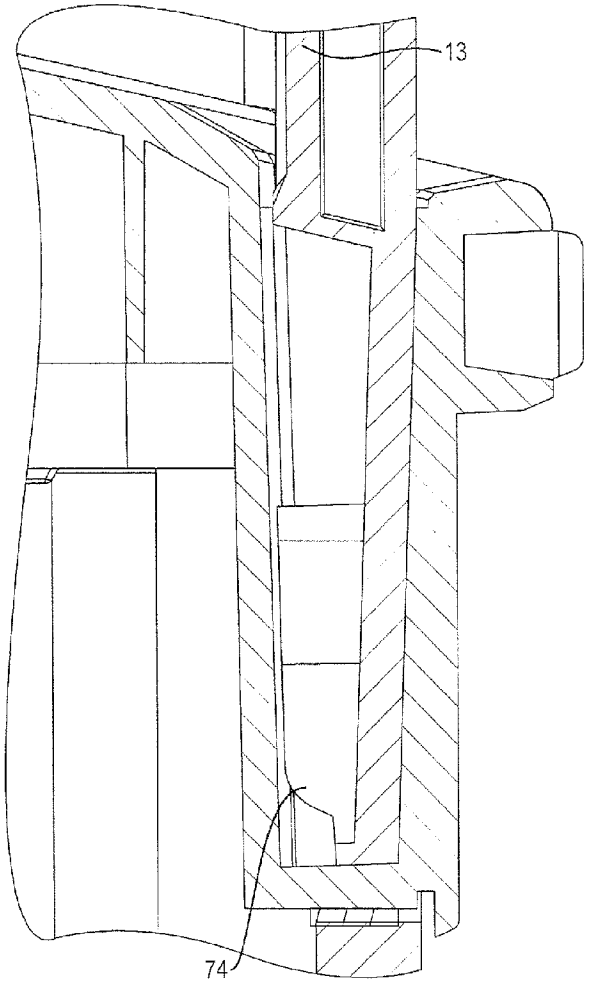
FIG. 6C is a partial cross-sectional view taken along line D-D of FIG. 6A.

A partial assembly 80, including a lower loudspeaker cabinet 60 and a deployed stand 10 that is adapted to support an upper loudspeaker cabinet, is shown in FIG. 4. Assembly 80 comprises stand 10 which is directly coupled to and supported by lower loudspeaker cabinet 60, which in one non-limiting example is a bass loudspeaker. Lower loudspeaker cabinet 60 has left and right receiving pockets 76 and 74 which are sized and shaped to accept leg wedges 13 and 15, respectively. Pocket 74 is shown in more detail in FIG. 5B and includes locating feature 75 which provides a unique shape onto which seating structure 36 of wedge 15 sits. In some examples, locating feature 75 may be a tapered wall. These features ensure that the stand is properly facing forward when it is engaged and coupled to loudspeaker cabinet 60. The engagement of a leg wedge of stand 10 in a lower loudspeaker cabinet receiving pocket is shown in more detail in FIGS. 6B and 6C. Wedge 13 fits into pocket 74 to provide a friction fit which inhibits or prevents the stand from lifting from the lower loudspeaker cabinet 60 when the upper loudspeaker cabinet 100 is lifted off of the stand.

Figure 7:
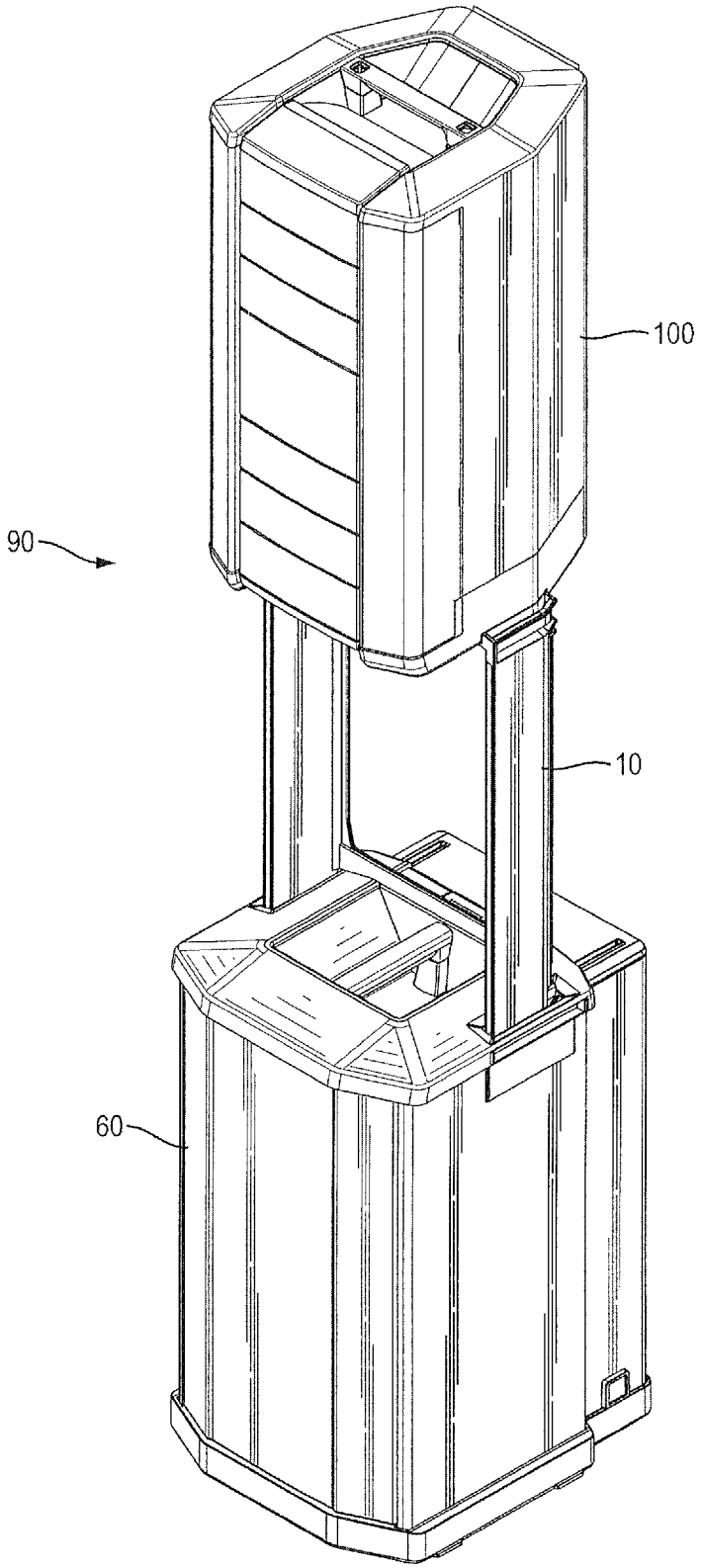
FIG. 7 is a front perspective view of an assembly comprising a lower loudspeaker cabinet, a stand, and an upper loudspeaker cabinet.
Figure 8:
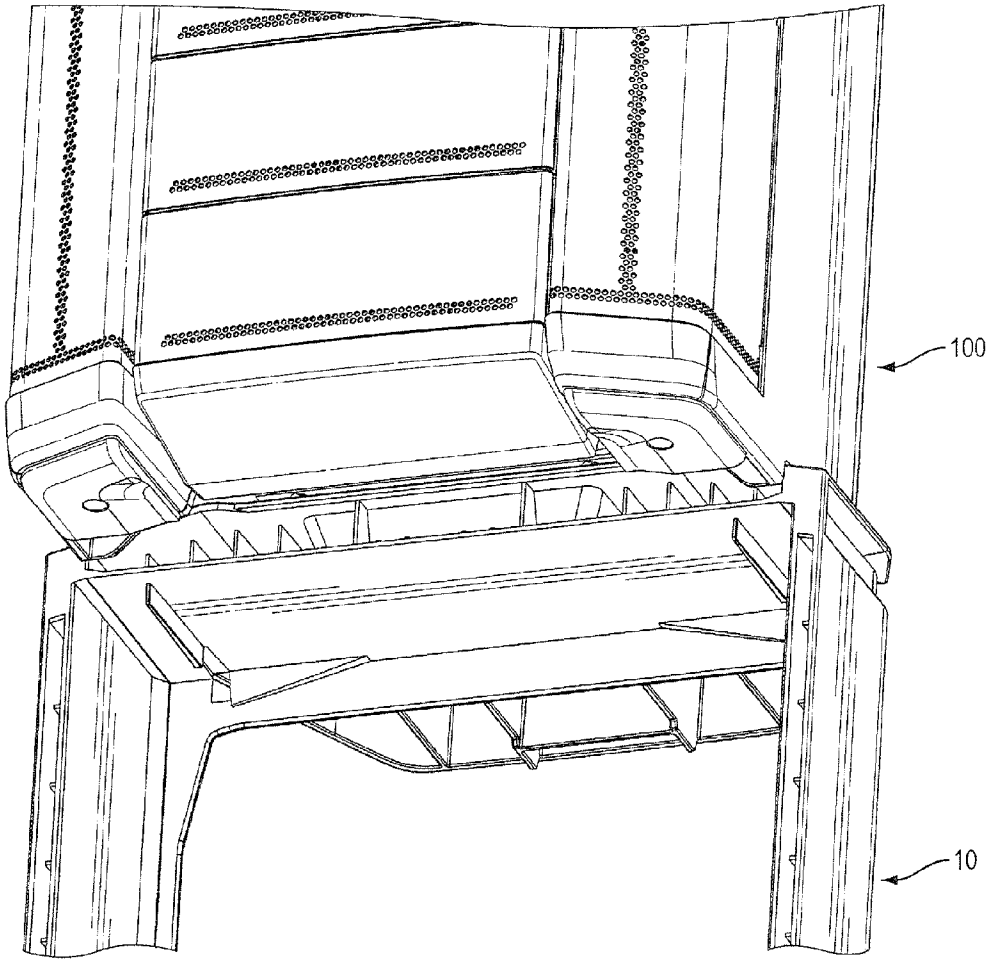
FIG. 8 is a rear lower perspective enlarged view detailing the coupling of the upper loudspeaker cabinet onto the stand of FIG. 7.
Figure 9:
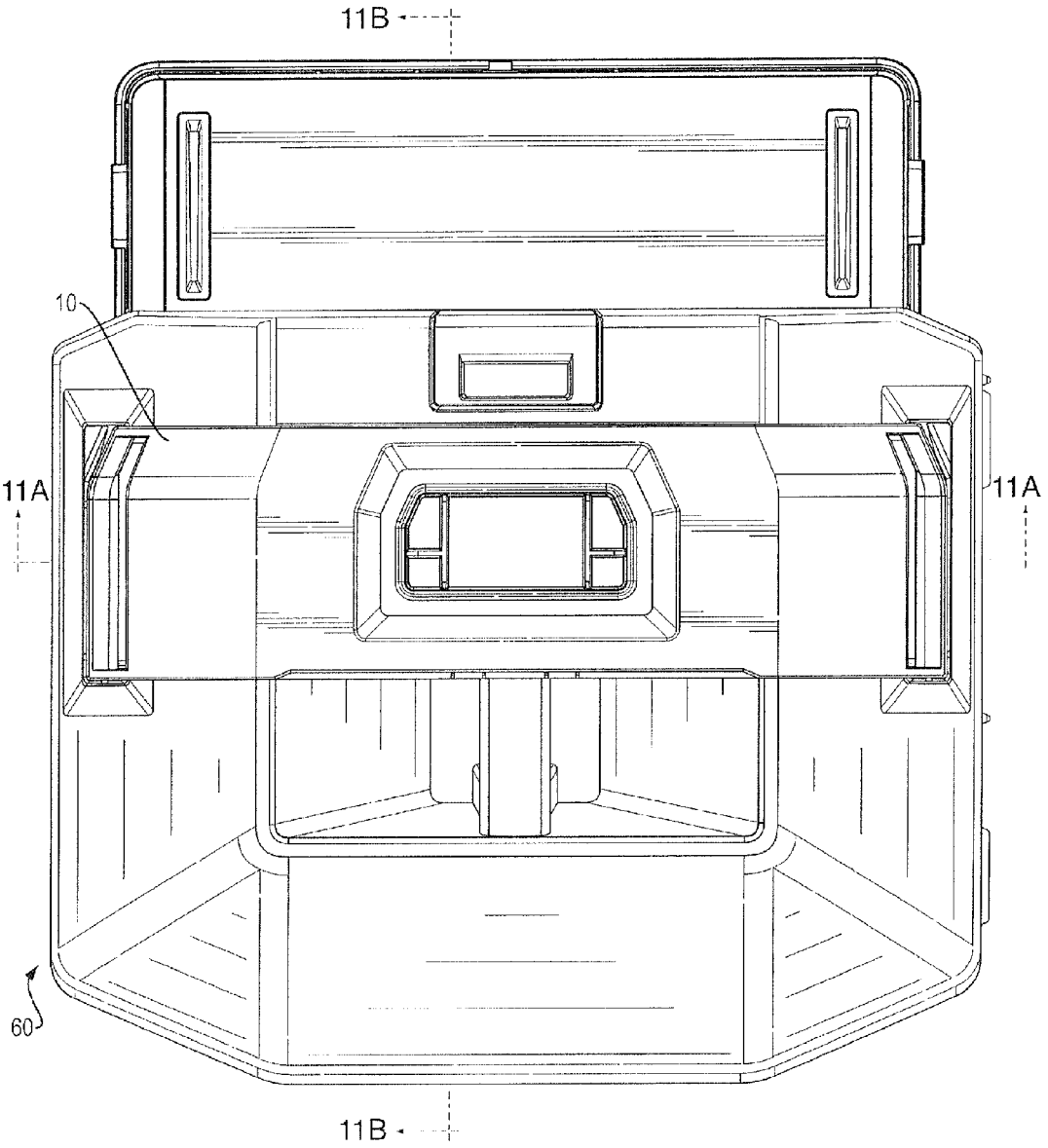
FIG. 9 is a top view of the assembly of FIG. 7, but with the upper loudspeaker cabinet removed.
Figure 10A:
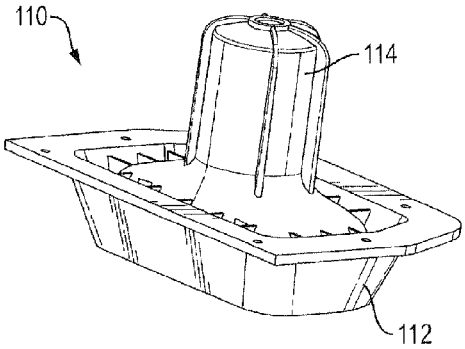
FIGS. 10A-10D are perspective, top, and cross-sectional views, respectively, of an interface coupling member for the upper loudspeaker cabinet, the cross-sectional views taken along lines A-A and B-B of FIG. 10B, respectively.
Figure 10B:
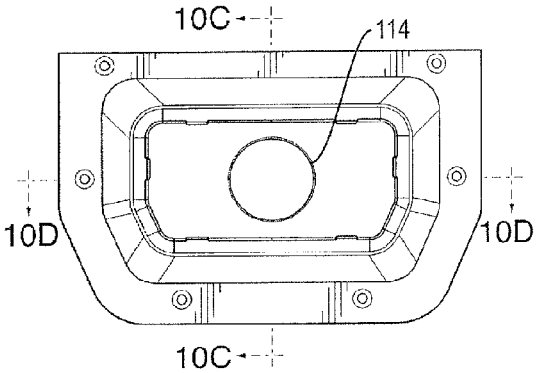
Figure 10C:
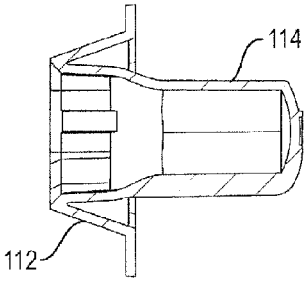
Figure 10D:
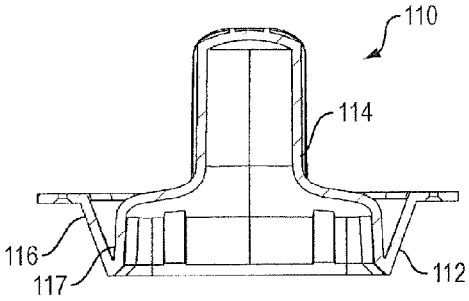

FIG. 7 illustrates a full assembly 90 with upper loudspeaker cabinet 100 mounted on stand 10 which is itself mounted on lower loudspeaker cabinet 60. In one non-limiting example, upper loudspeaker cabinet 100 comprises a mid/high speaker that can weigh in the range of 50 pounds, and lower loudspeaker cabinet 60 comprises a bass loudspeaker. The arrangement shown in FIG. 7 places cabinet 100 at desirable height for a live musical performance, typically in the range of about 5 feet from the stage. Assembly 90 thus accomplishes an integrated bass, mid and high range loudspeaker combination with a stand that can be stowed on or in the lower loudspeaker cabinet when not in use. Further, stand 10 greatly simplifies the physical act of mounting upper loudspeaker cabinet 100 above lower loudspeaker 60, as further described below.

In order to properly couple upper loudspeaker cabinet 100 to interface structure 24 of stand 10, the upper loudspeaker cabinet can be specifically designed to include a complementary projecting coupling structure. This same complementary structure can be provided as part of an interface coupling member 110 (see FIG. 10). In conventional loudspeaker assemblies that include an upper and lower loudspeaker cabinet, the upper loudspeaker cabinet is typically mounted at the top of a metal pole. The pole is placed into a receptacle built into the lower loudspeaker cabinet and projects several feet upward from the cabinet. The upper loudspeaker cabinet has a pole receptacle in its bottom. The upper loudspeaker cabinet is mounted by lifting the cabinet to height of about 5 feet and then placing the cabinet down on the pole such that the pole seats in this receptacle. Since the height of the pole is more or less at eye level, this is a blind coupling operation requiring the upper loudspeaker to be moved back and forth until it is seated on the pole. This can be a physically demanding operation, and can result in the loudspeaker being dropped which is a physical danger and also potentially an expensive mistake. The coupling system disclosed herein allows the seating of the upper loudspeaker cabinet without the user at the same time needing to support the 45 to 50 pound weight of the upper loudspeaker cabinet. Nevertheless, given that an upper loudspeaker cabinet may include a conventional pole receptacle, the stand 10 disclosed herein can optionally include complementary structure 110 to enable the stand 10 to interface with such an upper loudspeaker cabinet.

Figure 11A:
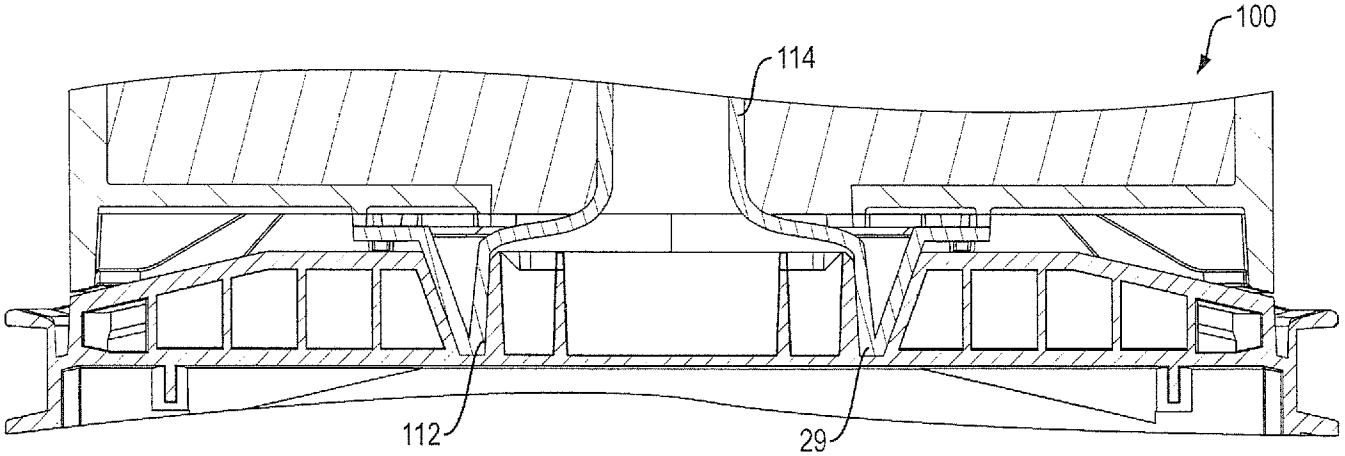
FIG. 11A is a cross-sectional view taken along line A-A FIG. 9 but including the upper loudspeaker cabinet.
Figure 11B:
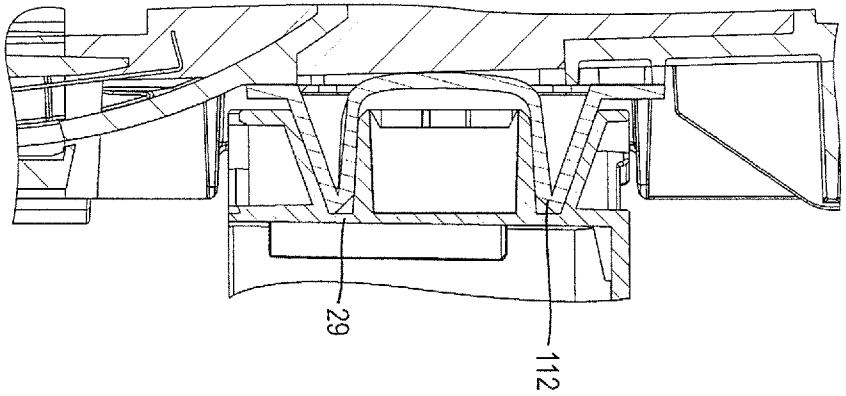
FIG. 11B is a cross-sectional view taken along line B-B of FIG. 9 but including the upper loudspeaker cabinet.

Interface coupling member 110, as shown in more detail in FIG. 10, may include coupling stud 114 that is sized and shaped to be fitted into a cylindrical pole-receiving receptacle in many existing upper loudspeaker cabinets. Stud 114 can be hollow as shown such that it defines a cylindrical receptacle that can optionally receive a pole in the manner described above. Also, interface coupling member 110 includes wedge shaped projection 112 which has a complementary shape to that of tapered recess 29 of interface structure 24, so that interface coupling member also allows the upper loudspeaker cabinet 100 to be mounted on stand 10. Wedge 112 in this example has outer inwardly-tapered wall 116 and inner outwardly-tapered wall 117. Wall 116 lies at the same angle as wall 28 of interface structure 24. Wall 117 lies at the same angle as wall 26 of interface structure 24. Wedge-shaped projection 112 thus seats directly into recess 29 as shown in the cross-sectional views of FIGS. 11A and 11B. The taper of inner wall 26 of interface structure 24 aligns with the inner wall 117 of projection 112 and the taper of outer wall 28 of interface structure 24 aligns with the outer wall 116 of projection 112. A result of this alignment is that projection 112 will bind in recess 29, preventing interface coupling member 110 from rotating out of interface structure 24.

The same complementary wedge and recess based coupling can be accomplished in other manners. For example, projection 112 or a similar wedge-shaped structure can be directly built into the bottom of upper loudspeaker cabinet 100 rather than being part of separate member 110. In this case, coupling can be accomplished without separate member 110.

As an alternative, the projection could be part of the stand rather than the upper loudspeaker cabinet, in which case the projection-receiving receptacle would be in the upper loudspeaker cabinet or in member 110 that was engaged with the upper loudspeaker cabinet. Also, other alternative manners of accomplishing an interfitting projection and receptacle at the mating surfaces of the stand and the upper loudspeaker cabinet are contemplated. Non-limiting examples include: wedge/receptacle pairs with shapes other than as illustrated in the drawings, and projections that are not wedge shaped but still accomplish a tight fit into a similarly-shaped receptacle.

Figure 12:
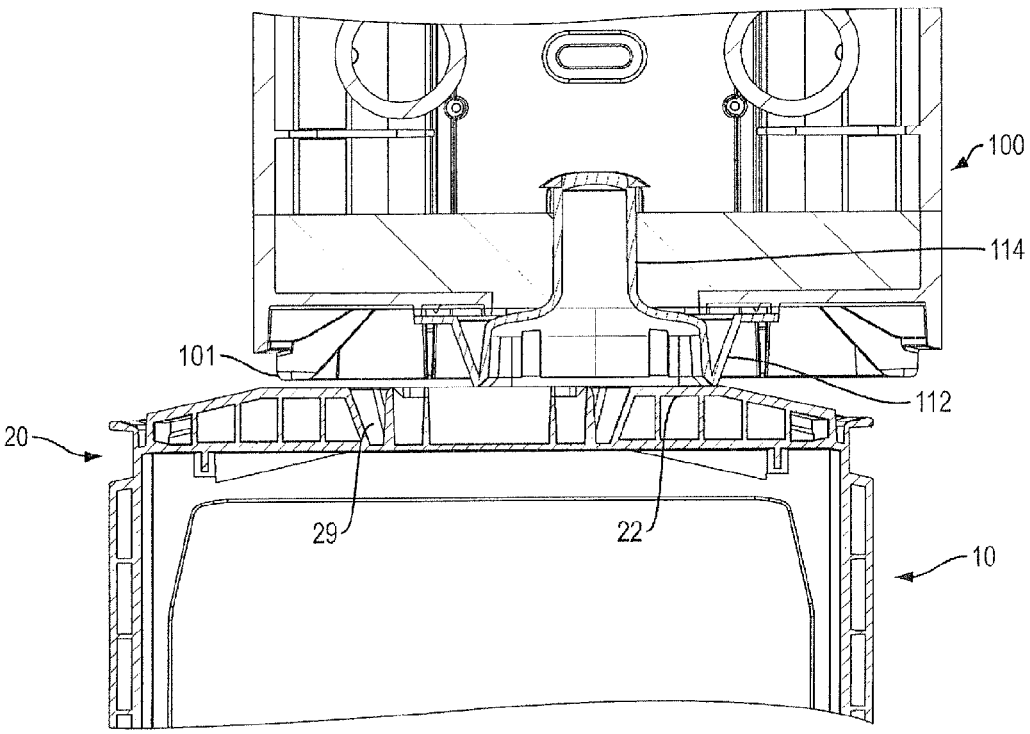
FIG. 12 is a cross-sectional view similar to that of FIG. 8 but showing the upper loudspeaker cabinet slightly misaligned with the stand.

FIG. 12 illustrates one advantage of the stand 10 described herein. This figure shows the upper loudspeaker cabinet 100 being coupled to stand 10. Cabinet 100 can be placed anywhere such that its bottom 101 sits on central area 22 of platform 20 of stand 10. Once this occurs, the user does not need to hold the weight of the loudspeaker any longer. Loudspeaker cabinet 100 can then be slid side to side and back and forth as necessary until wedge 112 falls into recess 29. At this point stand 10 will securely support loudspeaker cabinet 100 directly above lower loudspeaker cabinet 60.

Alternative arrangements are contemplated. For example, the stand can be stowed within rather than on the outside of the lower loudspeaker cabinet. This could be accomplished by including in the lower loudspeaker cabinet a pocket that is sized and shaped to stow the stand. Also, the stand does not need to have multiple legs and a platform. For example, the stand could be a pole that is able to be stowed in the lower loudspeaker cabinet, such as in a cylindrical blind hole in the cabinet (not shown in the drawings). Both the lower and upper loudspeaker cabinets would in this case include interface structures that allowed the pole to be coupled to them, in the deployed position. Such interface structures typically but not necessarily include complementary structures (e.g., pole-shaped recesses) on the stand and the respective loudspeaker cabinet. Such structures can be a tapered recess with a shape that matches an end of the stand, so as to create a tight fit.

A number of implementations have been described. Nevertheless, it will be understood that additional modifications may be made without departing from the scope of the inventive concepts described herein, and, accordingly, other embodiments are within the scope of the following claims.

What is claimed is:

1. A stand that is adapted, in a stand deployed position, to support an upper loudspeaker cabinet that has a bottom, relative to a lower loudspeaker cabinet that has a top, where the stand is further adapted to be stowed relative to the lower loudspeaker cabinet, the stand comprising:

a platform that comprises an interface structure, where the platform is constructed and arranged to support the bottom of the upper loudspeaker cabinet and the interface structure is constructed and arranged to engage with the bottom of the upper loudspeaker cabinet;

a plurality of legs the extend from the platform;

wherein when the stand is in the deployed position, the stand is supported on the lower loudspeaker cabinet with legs engaged in first positions of the lower loudspeaker cabinet and the platform located spaced from and above the top of the lower loudspeaker cabinet; and wherein when the stand is in a stowed position, a first structure of the stand engages with a second position of the lower loudspeaker cabinet, where the second position of the lower loudspeaker cabinet is different than the first positions of the lower loudspeaker cabinet.

2. The stand of claim 1 wherein the legs of the stand each comprises a wedge at a distal end of the respective leg, where each wedge is constructed and arranged to be received in one of a plurality of separate receiving pockets of the lower loudspeaker cabinet, wherein the receiving pockets comprise the first positions of the lower loudspeaker cabinet.

3. The stand of claim 1 wherein the interface structure comprises a tapered recess in the top of the platform.

4. The stand of claim 3 wherein the tapered recess comprises an annular recess bounded by inwardly-tapered outer walls and outwardly-tapered inner walls.

5. The stand of claim 4 wherein the inward taper of the outer recess walls is greater than the outward taper of the inner recess walls.

6. The stand of claim 1 further comprising a channel along a length of at least one leg and that is constructed and arranged to receive an electrical cord therein.

7. An assembly that is adapted to support an upper loudspeaker cabinet, comprising:

a bass loudspeaker cabinet; and a stand, wherein the stand comprises a first structure that is constructed and arranged to be directly coupled to a first portion of the bass loudspeaker cabinet in a stand stowed position wherein the stand is stowed on or in the bass loudspeaker cabinet; a second structure that is constructed and arranged to be directly coupled to a second portion of the bass loudspeaker cabinet in a stand deployed position wherein the stand is supported by and extends above the bass loudspeaker cabinet, where the first and second portions of the bass loudspeaker cabinet are different from one another; and a platform with an interface structure that is constructed and arranged to be engaged with and support the upper loudspeaker cabinet above the bass loudspeaker cabinet when the stand is in the deployed position, where when the stand is in the deployed position the interface structure is spaced from and above the bass loudspeaker cabinet.

8. The assembly of claim 7 wherein the bass loudspeaker cabinet comprises a movable latch, and the first structure of the stand comprises a recess in the platform that is constructed and arranged to engage the latch.

9. The assembly of claim 7 wherein the second portion of the bass loudspeaker cabinet comprises a receiving pocket and the second structure of the stand comprises a wedge that is constructed and arranged to be received in the receiving pocket of the bass loudspeaker cabinet.

10. The assembly of claim 7 wherein the stand comprises a platform that comprises the interface structure.

11. The assembly of claim 7 wherein the stand has a plurality of legs that support the platform, and wherein the second structures comprise distal portions of each leg.

12. The assembly of claim 11 wherein the interface structure comprises a tapered recess in the top of the platform.

13. The assembly of claim 12 wherein the tapered recess comprises an annular recess bounded by inwardly-tapered outer walls and outwardly-tapered inner walls.

14. The assembly of claim 13 wherein the inward taper of the outer recess walls is greater than the outward taper of the inner recess walls.

15. The assembly of claim 13 further comprising an interface coupling member that is adapted to be coupled to the upper loudspeaker cabinet and comprises an annular wedge-shaped projection that is shaped to fit into the tapered recess of the platform.

16. The assembly of claim 11 wherein each leg comprises a wedge at one end thereof.

17. The assembly of claim 11 wherein at least one leg comprises a channel along a length of such leg and that is constructed and arranged to receive an electrical cord therein.

18. The assembly of claim 11 wherein the stand has two legs that depend from opposite ends of the platform; and wherein the bass loudspeaker cabinet comprises a shelf that is constructed and arranged to support the platform in the stand stowed position, and two recesses, the recesses located below and adjacent to each end of the shelf, wherein in the stand stowed position one leg of the stand is received in each recess.

19. The assembly of claim 7 further comprising one or more elastomeric bumpers in the first portion of the bass loudspeaker cabinet.

20. The stand of claim 1 wherein the first structure of the stand comprises a recess in the platform, where the recess is constructed and arranged to receive a movable latch of the lower loudspeaker cabinet.

21. An assembly that is adapted to be supported on a lower loudspeaker cabinet, comprising:

an upper loudspeaker that comprises a first engaging structure on a bottom side thereof; and a stand, wherein the stand comprises a first structure that is constructed and arranged to be directly coupled to a first portion of the lower loudspeaker cabinet in a stand stowed position wherein the stand is stowed on or in the lower loudspeaker cabinet; a second structure that is constructed and arranged to be directly coupled to a second portion of the lower loudspeaker cabinet in a stand deployed position wherein the stand is supported by and extends above the lower loudspeaker cabinet, where the first and second portions of the lower loudspeaker cabinet are different from one another; and a platform with an interface structure that is constructed and arranged to be engaged with the first engaging structure of the upper loudspeaker such that the platform supports the upper loudspeaker cabinet above the lower loudspeaker cabinet when the stand is in the deployed position, where when the stand is in the deployed position the platform is spaced from and above the lower loudspeaker cabinet.

22. A bass loudspeaker that is constructed and arranged to support a stand and an upper loudspeaker, wherein the stand comprises a platform with an interface structure on a top side thereof, and a plurality of legs that extend from the platform and each comprise a distal structure at an end thereof, and wherein the upper loudspeaker comprises a first engaging structure on a bottom side thereof, the bass loudspeaker comprising:

a cabinet comprising a plurality of separate, spaced receptacles, each receptacle constructed and arranged to accept the distal structure of a leg of the stand, to support the stand on the cabinet in a stand deployed position with the stand extending above the cabinet and with the platform spaced from and above the cabinet; and wherein the cabinet further comprises a stand platform-receiving shelf that is separate from and at a different location of the cabinet from the plurality of receptacles, and a plurality of vertical recesses that are adjacent to the stand platform-receiving shelf, wherein the stand platform-receiving shelf is constructed and arranged to support the stand platform in a stand stowed position, with the stand legs located in the vertical recesses.

23. An upper loudspeaker that is constructed and arranged to be supported above and spaced from a lower loudspeaker by a stand, wherein the stand comprises a platform with an interface structure on a top side thereof, and a plurality of legs that extend from the platform and each comprise a distal structure at an end thereof, and wherein the lower loudspeaker comprises a plurality of separate, spaced structures that are each constructed and arranged to accept the distal structure of a leg of the stand, to support the stand on the lower loudspeaker in a stand deployed position with the stand extending above the lower loudspeaker and with the platform spaced from and above the lower loudspeaker, and a stand platform-receiving shelf that is separate from and at a different location of the lower loudspeaker from the separate, spaced structures, and a plurality of adjacent recesses, wherein the stand platform-receiving shelf is constructed and arranged to support the stand platform in a stand stowed position, with the stand legs located in the vertical recesses, the upper loudspeaker comprising:

a cabinet comprising a first engaging structure on a bottom side thereof, wherein the first engaging structure has a shape that is complementary to the stand platform interface structure such that the two can nest, such that the cabinet can be held above and spaced from the lower loudspeaker when the stand is in the deployed position.

* * * * *